US006742197B2

(12) United States Patent
Colletto

(10) Patent No.: US 6,742,197 B2
(45) Date of Patent: Jun. 1, 2004

(54) TRANSLATION DEVICE FOR A MOBILE WALL OF A SWIMMING POOL

(75) Inventor: Giorgio Colletto, Castiglione (IT)

(73) Assignee: A & T Europe S.p.A., Castiglione Delle Stiviere (IT)

( * ) Notice: Subject to any disclaimer, the term of this patent is extended or adjusted under 35 U.S.C. 154(b) by 0 days.

(21) Appl. No.: 10/230,470

(22) Filed: Aug. 29, 2002

(65) Prior Publication Data

US 2003/0041371 A1 Mar. 6, 2003

(30) Foreign Application Priority Data

Sep. 3, 2001 (IT) ..... MI20010485 U

(51) Int. Cl.[7] ..... E04H 4/00
(52) U.S. Cl. ..... 4/505
(58) Field of Search ..... 4/496, 497, 504, 4/505

(56) References Cited

U.S. PATENT DOCUMENTS 3,582,999 A 6/1971 Baker
3,935,599 A * 2/1976 Stark ..... 4/505
3,962,735 A * 6/1976 Davidson ..... 4/505
4,166,295 A * 9/1979 Schiron et al. ..... 4/505
4,206,521 A * 6/1980 Davidson ..... 4/505
4,292,696 A * 10/1981 Berger ..... 4/505
4,449,265 A * 5/1984 Hoy ..... 15/387
4,481,743 A * 11/1984 Jellen ..... 52/64
4,991,239 A * 2/1991 Corna et al. ..... 4/505

FOREIGN PATENT DOCUMENTS

JP 9-119231 * 6/1997

* cited by examiner

*Primary Examiner*—Tuan N. Nguyen
(74) *Attorney, Agent, or Firm*—Hedman & Costigan, P.C.

(57) ABSTRACT

A translation device for a mobile wall of a swimming pool, where the pool (10) is four-sided and is equipped, near to its two opposite sides, with two parallel rails (14, 114), being foreseen a mobile wall or bridge (12, 112) which moves along such rails (14, 114) through at least two wheels (16, 116), aligned and positioned on each side end of the mobile wall (12, 112), where, for each side end of the mobile wall (12, 112), at least one of such wheels (16, 116) is moved through a gear.

7 Claims, 4 Drawing Sheets

TRANSLATION DEVICE FOR A MOBILE WALL OF A SWIMMING POOL

The present application claims priority to Italian Patent Application Serial No. MI 2001U 000485, filed Sep. 3, 2001.

BACKGROUND OF THE INVENTION

The present invention refers to a translation device for a mobile wall of a swimming pool.

In the field of swimming pools, to simultaneously conduct different activities inside the same pool, mobile walls, also known as mobile bridges, are used. It is thus simple to form two separate spaces for training and recreational activities and for swimming lessons from a single large area.

Normally such a mobile wall is made up of a stainless steel structure, which is covered with a plastic grill, for example made from ABS. However, other embodiments are possible, for example using entirely glass resin or other materials.

Moreover, the mobile wall can be equipped with other accessories, such as a manrope for swimmers, anchorings for floating lane marker ropes, and fixed or removable starting blocks.

The wall must be able to translate, for example generally along the longer sides of a rectangular swimming pool, to be positioned in the desired position.

Such a translation normally takes place through wheels, the axes of which are integral at the side with the wall. Such wheels move on two parallel rails, placed near to the longer sides of the pool or to another two opposite sides, in the case of a four-sided pool.

To displace the wall, at least two people generally act, one at each end of the wall. The speed of displacement is a few meters per minute.

The mobile wall is indeed an object which has a large contact surface with the water, which involves a substantial resistance to displacement.

Moreover, according to the laws of hydrodynamics, this resistance increases with the square of the speed of translation, for which reason a small increase in the speed requires a substantial applied force.

SUMMARY OF THE INVENTION

The purpose of the present invention is that of realising a translation device for a mobile wall of a swimming pool, which makes the displacement of the wall less demanding and easier.

Another purpose of the present invention is that of realising a translation device for a mobile wall of a swimming pool which is particularly simple and functional, with small costs.

These purposes according to the present invention are achieved by a translation device for a mobile wall of a swimming pool wherein said swimming pool comprises four sides with two parallel rails (14, 114) near two opposite sides of said swimming pool, said translation device comprising a mobile wall or bridge (12, 112) said mobile wall comprising two side ends parallel to the direction of translation, wherein said mobile wall (12, 112) moves along said rails (14, 114) by at least two wheels (16, 116), aligned and positioned on each side end of said mobile wall (12, 112), wherein for each side end of said mobile wall (12, 112), at least one of said wheels (16, 116) is moved by a sprocket (22, 122), wherein a shaft of at least one wheel (16, 116) is connected to said sprocket (22, 122), said sprocket (22, 122) being connected to a pinion (26, 126) by a closed-loop chain (24, 124), said pinion (26, 126) being rotated by an actuation means (28, 129, 130).

Further characteristics and advantages of the translation device for a mobile wall of a swimming pool are object of the dependent claims.

BRIEF DESCRIPTION OF THE DRAWING

The characteristics and advantages of a translation device for a mobile wall of a swimming pool according to the present invention shall become clearer from the following description, given as an example and not for limiting purposes, referring to the attached schematic drawings in which.

DETAILED DESCRIPTION OF THE INVENTION

Figure 1:
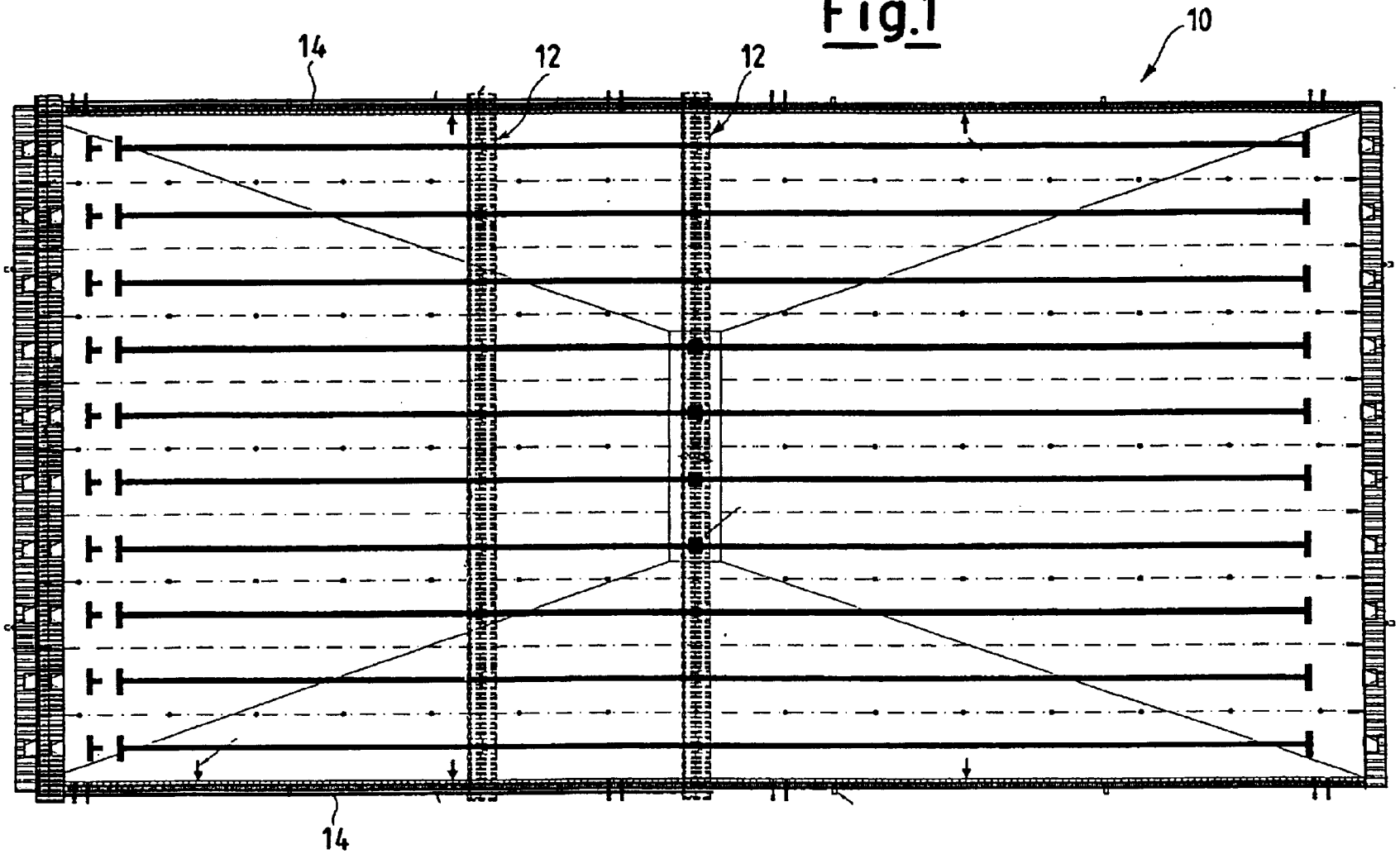
FIG. 1 is a plan view from above of a swimming pool equipped with a mobile wall or bridge, according to the prior art.

With reference to FIG. 1, a swimming pool is shown, wholly indicated with 10, equipped with a mobile wall or bridge 12.

The swimming pool 10 is four-sided, for example rectangular, and has near to its two opposite sides, for example its two longer sides, two rails 14, parallel to each other and, in the example shown in FIG. 1, for a portion less than the length of the entire longer side of the pool 10.

Figure 2:
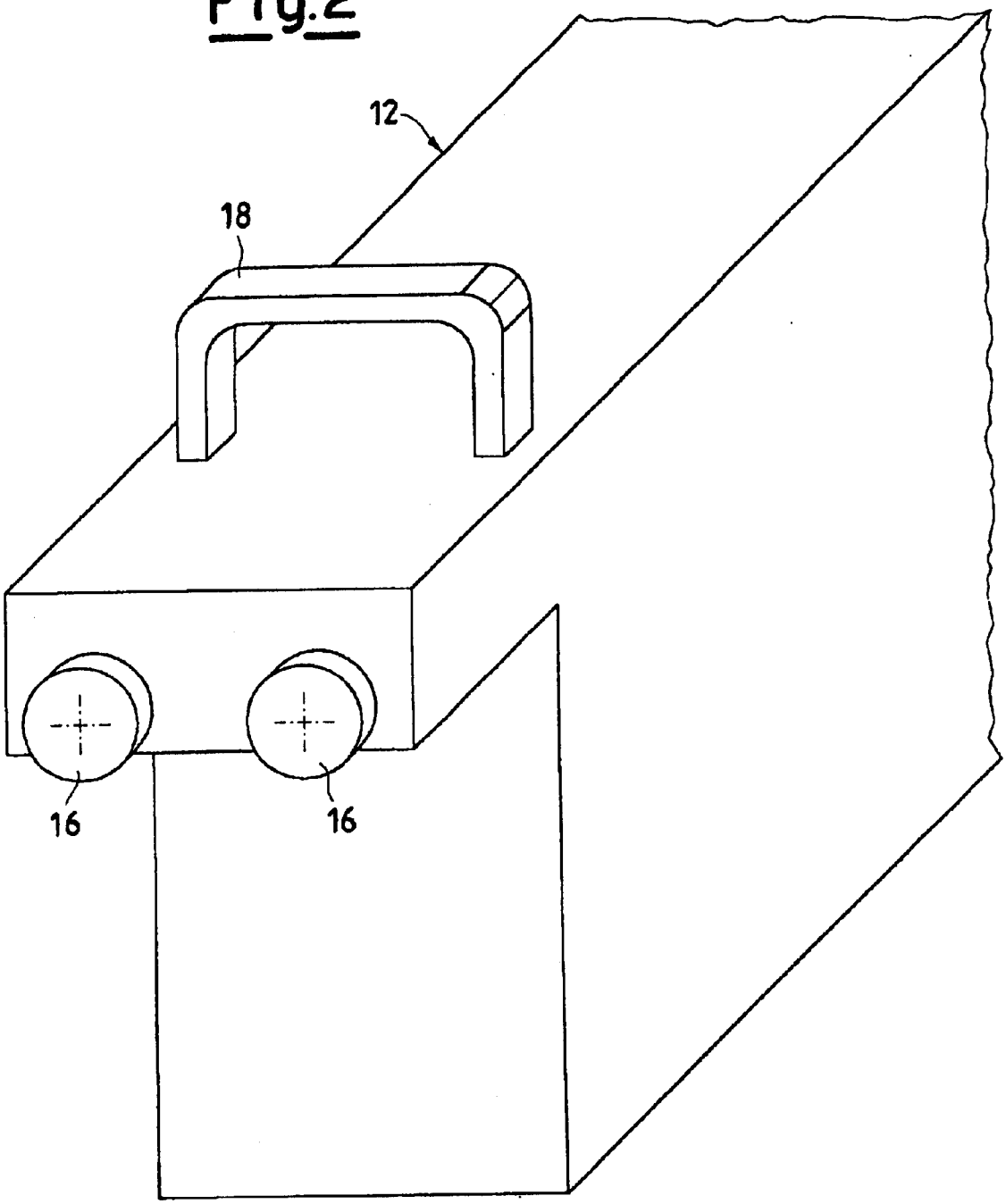
FIG. 2 is an enlarged axonometric view of a side portion of the wall of FIG. 1, according to the prior art.

With reference to FIG. 2, a side portion of the mobile wall 12 is shown, where it can be seen that the wall 12 is equipped, on each side, with two wheels 16, having parallel shafts fixed at the same height onto a side end of the wall 12 itself, and with a handle 18.

Figure 3:
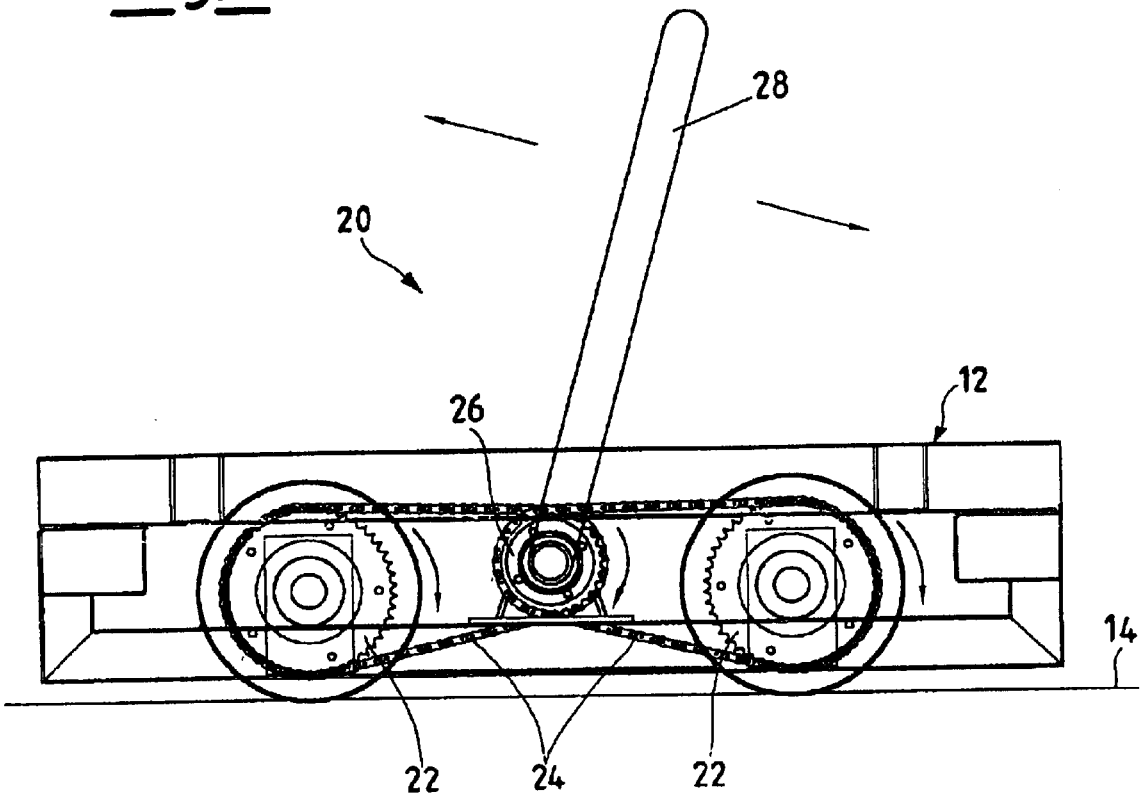
FIG. 3 is a side elevation view of a translation device for a mobile wall of a swimming pool, according to a first embodiment of the present invention.

With reference to FIG. 3, a first embodiment of a translation device for the wall 12 is shown, wholly indicated with 20. It should be noted that only one side end of the wall 12 is represented, since the opposite end is perfectly symmetrical.

The device 20 comprises, for each side end, two sprockets 22, fixed integrally onto the shafts of the wheels 16, two closed-loop chains 24, a pinion 26 and a ratchet mechanism 28, which makes the pinion 26 rotate. The pinion 26 has its shaft parallel to those of the wheels 16 and is positioned between such wheels 16. The pinion 26 has two sprockets side by side which are connected to the two sprockets 22 through the two chains 24.

The operation of the translation device 20 according to the invention is clear from that which has been described with reference to FIGS. 1, 2, and 3, and in short is the following.

Two people, one on each side of the mobile wall 12, act upon the ratchet mechanisms 28, which make the pinions 26 rotate. Through the chains 24, the pinions 26 make the sprockets 22, and consequently the wheels 16 connected to them, rotate simultaneously.

With the rotation of the four wheels 16, which are in complementary pairs operatively aligned with the two rails 14, the mobile wall 12 is translated in one of its two directions.

It should be specified that the ratchet mechanism 28 is reversible to allow the translation in the two directions.

Figure 4:
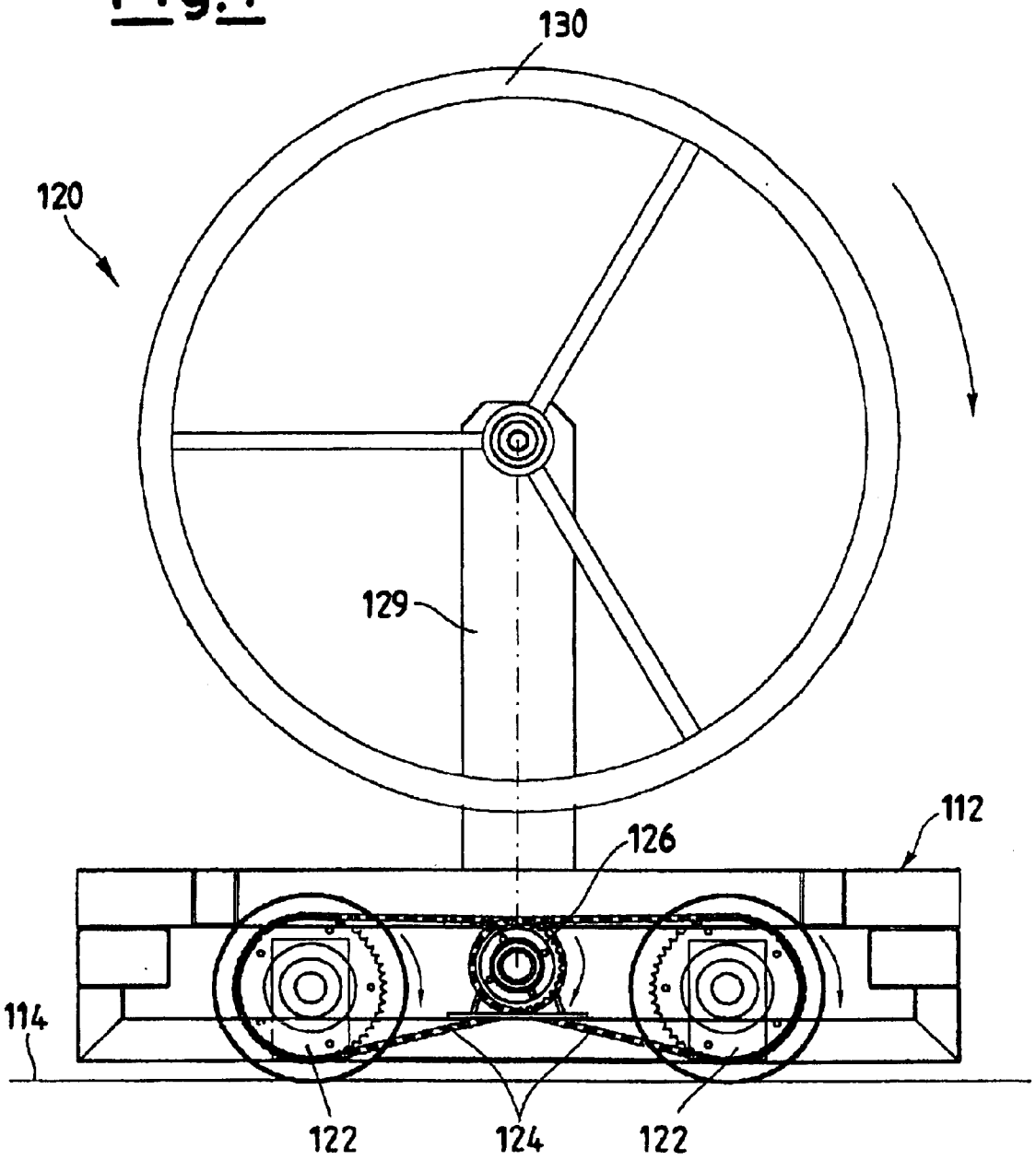
FIG. 4 is a side elevation view of a translation device for a mobile wall of a swimming pool, according to a second embodiment of the present invention.

FIG. 4 illustrates a further possible embodiment of the invention, where components which are identical and/or equivalent to those illustrated in FIG. 3 carry the same reference numerals increased by 100.

This second embodiment differs from the first just for the type of actuation of the pinion 26, indicated in FIG. 3. In FIG. 4, indeed, it can be seen how the pinion 126 is made to rotate through a maneuvering wheel 130, to be rotated manually.

The wheel 130 is fixed at the side to the structure of the mobile wall 112 on a vertical support 129. The shaft of the wheel 130 is connected to the shaft of the pinion 126 through, for example, a chain or a belt (not visible in FIG. 4).

It is clear that to rotate the pinion 26 of FIG. 3 alternative mechanisms are possible. In particular, in the second embodiment for example, the shaft of the wheel 130 could also be moved by an electric or pneumatic motor.

The translation device for a mobile wall of a swimming pool object of the present invention has the advantage of making the operations for moving the wall itself particularly simple.

Moreover, by suitably combining the diameter of the wheel, in the first embodiment, or the length of the lever of the ratchet mechanism, in the second embodiment, and the diameters of the various gears it is possible to reduce the force required for the translation.

The translation device for a mobile wall of a swimming pool thus conceived is susceptible to numerous modifications and variants, all covered by the invention; moreover, all of the details can be replaced by technically equivalent elements. In practice, the materials used, as well as the sizes, can be whatever according to the technical requirements.

What is claimed is:

1. A translation device for a mobile wall (12, 112) of a swimming pool (10), wherein said swimming pool comprises four sides with two parallel rails (14, 114) near two opposite sides of said swimming pool, said translation device comprising a mobile wall or bridge (12, 112) said mobile wall comprising two side ends parallel to the direction of translation, wherein said mobile wall (12, 112) moves along said rails (14, 114) by at least two wheels (16, 116), aligned and positioned on each side end of said mobile wall (12, 112), wherein for each side end of said mobile wall (12, 112), at least one of said wheels (16, 116) is moved by a sprocket (22, 122), wherein a shaft of at least one wheel (16, 116) is connected to said sprocket (22, 122), said sprocket (22, 122) being further connected to a pinion (26, 126) by a closed-loop chain (24, 124), said pinion (26, 126) being rotated by an actuation means (28, 129, 130).

2. The device according to claim 1, wherein said actuation means comprises a ratchet mechanism (28) which acts upon a shaft of said pinion (26).

3. The device according to claim 1, wherein said actuation means comprises a maneuvering wheel (130), mounted on a support (129) fixed to said mobile wall (112), which leads to a rotation of said shaft of said pinion (126) by connection elements.

4. The device according to claim 3, wherein said wheel (130) is moved by an electric or pneumatic motor.

5. The device according to claim 4, wherein said connection elements are chains or belts.

6. The device according to claim 1, wherein said pinion (26, 126) is moved by an electric or pneumatic motor, which acts as said actuation means (28, 129, 130).

7. The device according to claim 1, wherein, for each side end of said mobile wall (12, 112), there are two wheels (16, 116), with two identical sprockets (22, 122) being fitted onto said shafts of said wheels (16, 116), wherein said sprockets (22, 122) are connected to a pinion (26, 126) by two closed-loop chains (24, 124), said pinion (26, 126) being rotated by said actuation means (28, 129, 130).

* * * * *